US007684739B2

(12) United States Patent
Maruyama

(10) Patent No.: US 7,684,739 B2
(45) Date of Patent: Mar. 23, 2010

(54) TONER TRANSPORT APPARATUS AND IMAGE FORMING APPARATUS

(75) Inventor: Kei Maruyama, Osaka (JP)

(73) Assignee: Kyocera Mita Corporation (JP)

( * ) Notice: Subject to any disclaimer, the term of this patent is extended or adjusted under 35 U.S.C. 154(b) by 298 days.

(21) Appl. No.: 11/789,819

(22) Filed: Apr. 26, 2007

(65) Prior Publication Data

US 2007/0253745 A1 Nov. 1, 2007

(30) Foreign Application Priority Data

Apr. 28, 2006 (JP) ..... 2006-126216

(51) Int. Cl.
*G03G 15/08* (2006.01)

(52) U.S. Cl. ..... 399/258; 399/254

(58) Field of Classification Search ..... 399/258, 399/227

See application file for complete search history.

(56) References Cited

U.S. PATENT DOCUMENTS 6,366,755 B1 * 4/2002 Takashima ..... 399/254
6,516,157 B1 * 2/2003 Maruta et al. ..... 399/8
2004/0265011 A1 * 12/2004 Tsuda et al. ..... 399/260
2005/0265759 A1 * 12/2005 Takeuchi et al. ..... 399/359
2006/0210314 A1 * 9/2006 Yamada et al. ..... 399/227

FOREIGN PATENT DOCUMENTS

JP 10-198149 7/1998

* cited by examiner

*Primary Examiner*—David M Gray
*Assistant Examiner*—Roy Yi
(74) *Attorney, Agent, or Firm*—Gerald E. Hespos; Anthony J. Casella

(57) ABSTRACT

A toner transport apparatus that transports toner particles and includes a lateral transport device and a longitudinal transport device. The lateral transport device includes a lateral tube extending in a lateral direction and a lateral transport member provided inside the lateral tube in a rotatable manner and transporting toner particles. The longitudinal transport device includes a longitudinal tube coupled to an end of the lateral tube and extending in a longitudinal direction and a longitudinal transport member provided inside the longitudinal tube in a rotatable manner and transporting toner particles downward, and thereby transports the toner particles transported from the lateral transport device downward. An end portion of the lateral transport member on a downstream side in a toner transport direction extends to an inside of the longitudinal tube.

13 Claims, 5 Drawing Sheets

TONER TRANSPORT APPARATUS AND IMAGE FORMING APPARATUS

BACKGROUND OF THE INVENTION

1. Field of the Invention

The present invention relates to a toner transport apparatus, and more particularly, to a toner transport apparatus that transports toner particles laterally first and then downward and an image forming apparatus to which the same is applied.

2. Description of the Related Art

An image forming apparatus, such as a printer, is provided with an image forming portion including a photoconductive drum and a developing device, a sheet feeding portion that feeds recording sheets to the image forming portion, a sheet carrying portion that carries recording sheets bearing formed images, a fixing portion that fixes toner images on recording sheets, and a sheet discharge portion where recording sheets onto which are fixed the toner images are discharged.

In the image forming apparatus thus configured, an electrostatic latent image is formed on the surface of the photoconductive drum according to image information, and after the electrostatic latent image is developed to a toner image by the developing device, the developed toner image is transferred onto a recording sheet. In the case of a full-color image forming apparatus, such as a color printer, four developing devices respectively storing developing agents in cyan, magenta, yellow, and black are provided, and development in these four colors, cyan, magenta, yellow, and black, is performed by the corresponding developing devices.

With such a full-color image forming apparatus, personal use has been increasing in recent years, and so is a need to reduce the apparatus both in size and cost. To meet this need, a compact image forming apparatus adopting a rotary developing apparatus is now being developed. In this rotary developing apparatus, developing devices respectively corresponding to toner particles in plural colors are supported on a rotary frame body.

In order to achieve a reduction of the rotary frame body in size as well as a reduction in load when driving the rotary frame body, the rotary developing apparatus adopts a method by which a toner container storing toner particles is provided apart from the rotary frame body so as to replenish the developing devices on the rotary frame body with toner particles from the outside toner container (for example, JP-A-10-198149).

For an image forming apparatus adopting the method of replenishing the developing devices with toner particles from the outside toner container, there is a need for a toner transport apparatus that transports toner particles from the toner container to the developing devices. When toner particles are replenished, the replenishing efficiency of toner particles is enhanced by inserting a toner replenishing pipe into the developing devices from above. It is therefore configured in such a manner that the toner replenishing pipe transports toner particles in a longitudinal direction. Meanwhile, it is often difficult to place the toner container above the toner replenishing pipe due to limitations of space within the apparatus. Accordingly, there arises a need to provide a transport apparatus that transports toner particles in a lateral direction between the toner container and the toner replenishing pipe.

As has been described, a transport apparatus that transports toner particles in a lateral direction and another transport apparatus that transports toner particles in a longitudinal direction are necessary between the toner container and the developing devices. In this case, in the event that toner particles are not delivered in a satisfactory manner at transition between lateral transportation and longitudinal transportation, toner particles may possibly build up at the transition point.

SUMMARY OF THE INVENTION

An object of the invention is to prevent built-up of toner particles in an apparatus that transports toner particles laterally (in a first direction) and longitudinally (in a second direction) by performing a delivery of toner particles in a satisfactory manner at transition between lateral transportation and longitudinal transportation.

In order to achieve the above and other objects, a toner transport apparatus according to one aspect of the invention is provided with: a lateral transport device that includes a lateral tube extending in a lateral direction and a lateral transport member provided inside the lateral tube in a rotatable manner and transporting toner particles; and a longitudinal transport device that includes a longitudinal tube coupled to an end of the lateral tube and extending in a longitudinal direction and a longitudinal transport member provided inside the longitudinal tube in a rotatable manner and transporting toner particles downward, and thereby transports the toner particles transported from the lateral transport device downward, wherein an end portion of the lateral transport member on a downstream side in a toner transport direction extends to an inside of the longitudinal tube.

An image forming apparatus according to another aspect of the invention includes: an electrostatic latent image carrying body; a developing apparatus that supplies the electrostatic latent image carrying body with toner particles; a toner container that stores the toner particles; and a toner transport apparatus that transports the toner particles from the toner container to the developing apparatus, wherein the toner transport apparatus has the configuration described above.

A toner transport apparatus according to still another aspect of the invention is provided with: a first transport device that includes a first tube extending in a specific first direction and a first transport member provided inside the first tube in a rotatable manner and transporting toner particles in the first direction; and a second transport device that includes a second tube coupled to an end of the first tube and extending in a second direction different from the first direction and a second transport member provided inside the second tube in a rotatable manner and transporting toner particles in the second direction, and thereby transports the toner particles transported from the first transport device in the second direction, wherein an end portion of the first transport member on a downstream side in a toner transport direction extends to an inside of the second tube.

An image forming apparatus according to still another aspect of the invention includes: an image forming portion that forms an image using toner particles; a first container that stores the toner particles; a second container into which the toner particles stored in the first container are transferred; and a toner transport apparatus that transports the toner particles from the first container to the second container, wherein the toner transport apparatus has the configuration described above.

DETAILED DESCRIPTION OF THE PREFERRED EMBODIMENTS

Figure 1:
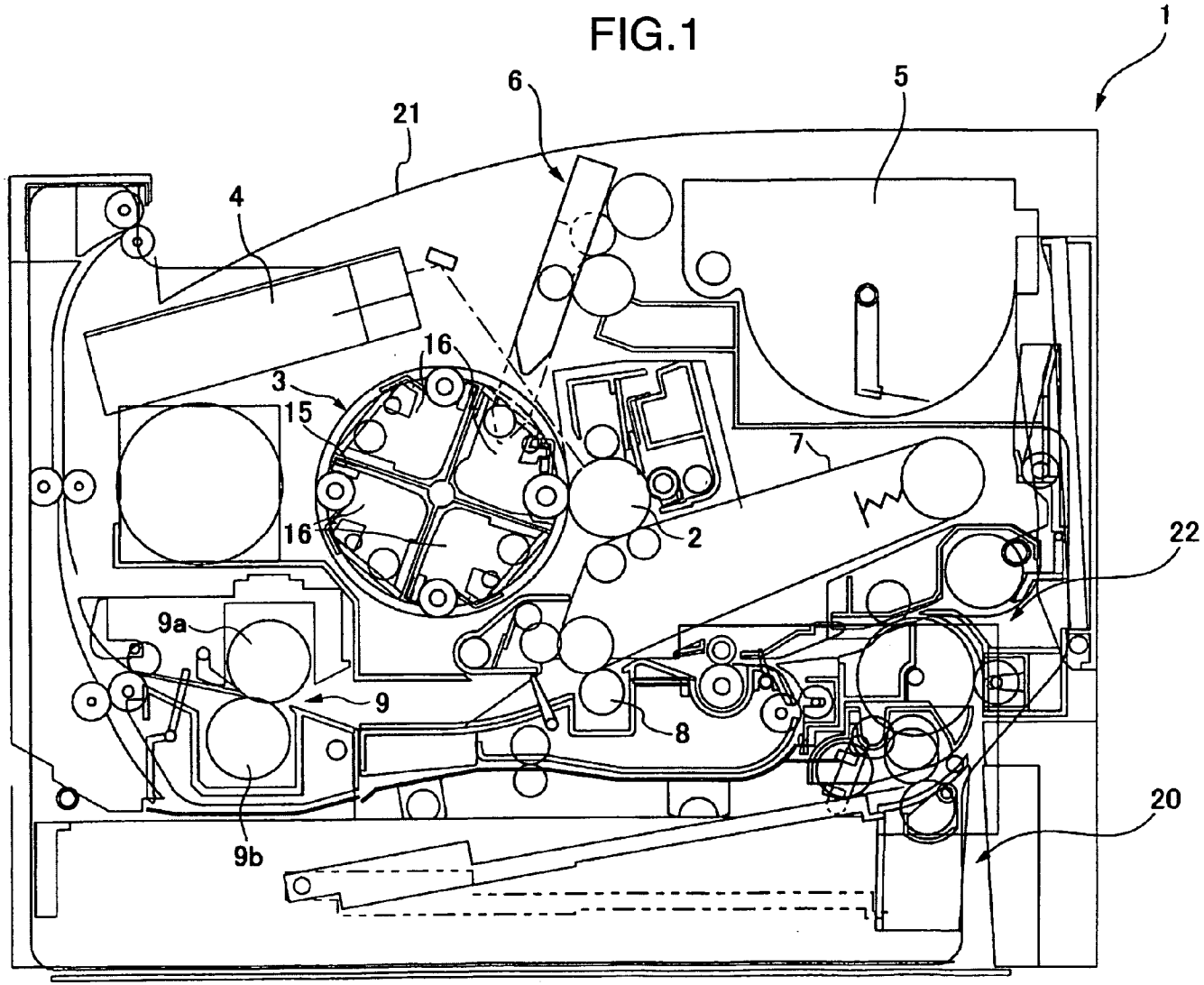
FIG. 1 is a view schematically showing the configuration of a color printer to which a toner transport apparatus according to one embodiment of the invention is applied.

FIG. 1 is a view schematically showing the configuration of a color printer 1 adopting a toner transport apparatus according to one embodiment of the invention. FIG. 1 is a schematic view to indicate the locations of respective components and details of respective portions are omitted herein.

Overall Configuration

The color printer 1 is an apparatus connected to an unillustrated computer or the like and capable of printing a color image on a recording sheet according to image information sent from the computer or the like.

The color printer 1 has a photoconductive drum 2, a rotary developing apparatus 3, a laser unit 4 that scans exposing light on the photoconductive drum 2 according to the image information sent from the outside computer or the like, a toner storing portion 5, a toner supply portion 6, an intermediate transfer belt 7 and a secondary transfer roller 8 used to transfer a toner image on the photoconductive drum 2 onto a recording sheet, and a fixing device 9.

The photoconductive drum 2, on the surface of which an electrostatic latent image is formed, is provided almost at the center of the apparatus in a rotatable manner, and the rotational shaft thereof is provided to extend perpendicularly to the sheet surface of FIG. 1. A charging roller that charges the surface of the photoconductive drum 2 uniformly and a drum cleaning device that removes residual toner particles and adhesive materials on the surface of the photoconductive drum 2 are provided on the periphery of the photoconductive drum 2.

The rotary developing apparatus 3 develops an electrostatic latent image formed on the photoconductive drum 2 into toner images using toner particles in respective colors, and is provided adjacently to the photoconductive drum 2. The rotary developing apparatus 3 has a rotary frame 15 and four developing devices 16 provided respectively for toner particles in four colors and supported on the rotary frame 15. The rotary frame 15 is of a cylindrical shape rotatable about the shaft parallel to the rotational shaft of the photoconductive drum 2, and is configured to be rotated by an unillustrated driving mechanism including a motor and a gear. In addition, the rotary frame 15 has four sections, which are quarters divided in the circumferential direction by partition frames extending radially from the center of the rotational shaft, and the developing devices 16 corresponding to four toner colors, yellow, cyan, magenta, and black, are disposed respectively in these sections.

All the developing devices 16 are of almost the same configuration and each is provided with a developing roller that can be disposed oppositely to the photoconductive drum 2, a stirring roller for stirring toner particles, and so forth. For toner particles from the toner supply portion 6 to be supplied to the inside of the developing device 16, a toner supply port is made in the housing of the developing device 16 on the outer circumference side. This toner supply port is made by forming an opening in a part of the housing and by fixing an elastic member provided with a slit to this opening.

The toner storing portion 5 is a portion in which to store toner particles to be supplied to the respective developing devices 16 in the rotary developing apparatus 3, and is disposed above the photoconductive drum 2 and at the end portion of the apparatus. The toner storing portion 5 has four toner containers that are disposed side by side in a lateral direction (a direction perpendicular to the sheet surface of FIG. 1) and store toner particles in respective colors, yellow, cyan, magenta, and black. The four toner containers can be individually taken out to the outside of the apparatus.

The fixing device 9 fuses toner particles transferred onto a recording sheet to be fixed thereon, and has a heating roller 9*a* having an internal heater and a pressure roller 9*b* that is pressed against the heating roller 9*a*. The fixing device 9 carries a recording sheet by nipping it between these two rollers 9*a* and 9*b*.

The color printer 1 is also provided with a sheet feeding cassette 20 that accommodates recording sheets at the lower portion of the apparatus, and at the top surface of the apparatus, a discharge portion 21 on which are stacked recording sheets bearing formed images is provided. A sheet carrying path 22 through which recording sheets are carried is provided between the sheet feeding cassette 20 and the discharge portion 21.

Toner Supply Portion

Figure 2:
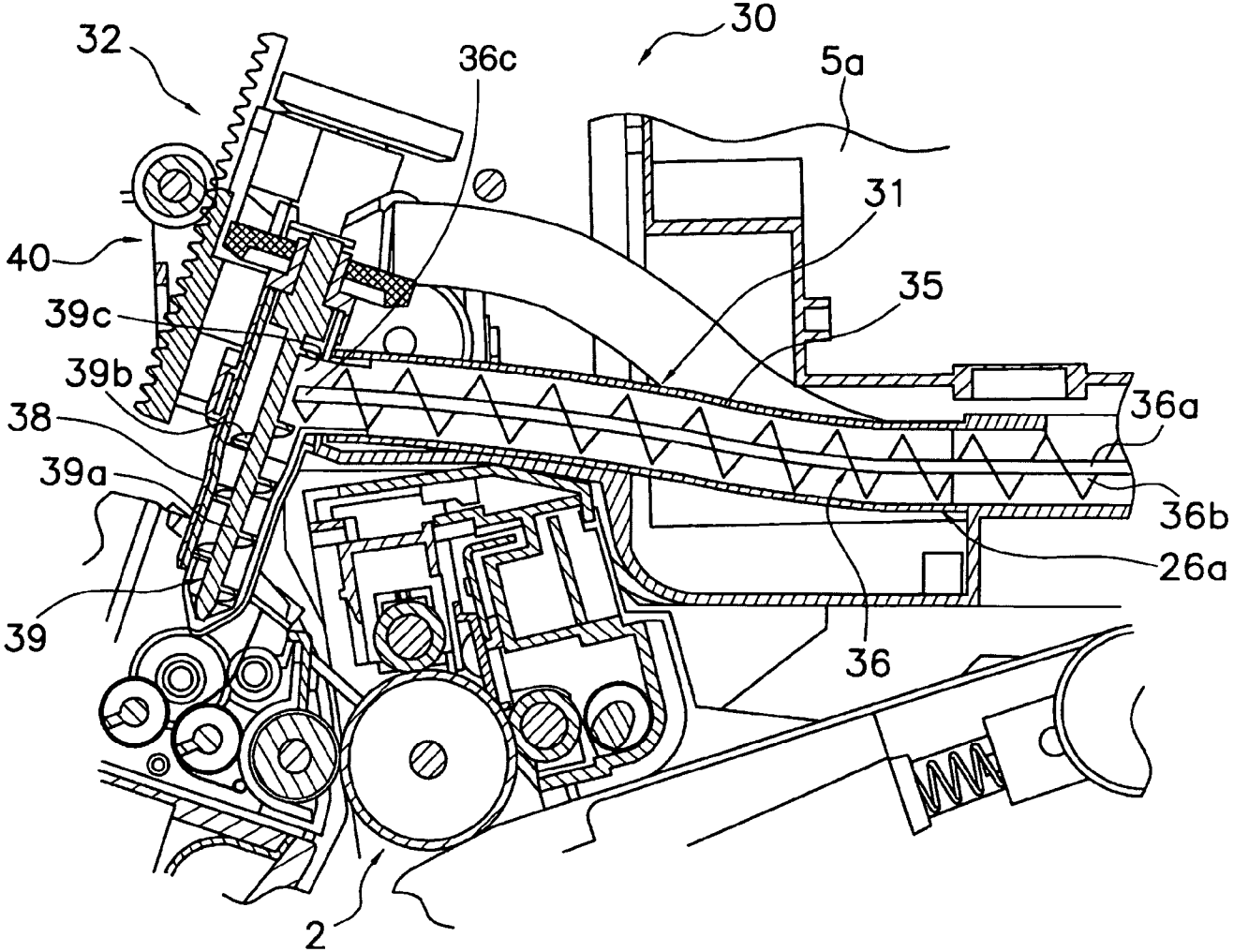
FIG. 2 is a cross section showing the configuration of a toner supply portion in detail.

The toner supply portion 6 will now be described in detail. As is obvious from FIG. 1 and FIG. 2 showing an enlarged view of the toner supply portion 6, the toner supply portion 6 supplies toner particles in respective colors stored in the toner storing portion 5 to the corresponding developing devices 16. The toner supply portion 6 has four pieces of toner transport apparatus 30 provided between the four toner containers and the corresponding developing devices 16. The four pieces of toner transport apparatus 30 are of almost the same configuration.

Each toner transport apparatus 30 has a lateral transport device 31 (first transport device) that transports toner particles from the toner container 5*a* (see FIG. 2) in a lateral direction and a longitudinal transport device 32 (second transport device) that transports the toner particles transported from the lateral transport device 31 downward in a longitudinal direction.

The lateral transport device 31 has a lateral tube 35 (first tube) extending in the lateral direction and a lateral screw 36 (first transport member) serving as a lateral transport member provided inside the lateral tube 35 in a rotatable manner.

The lateral tube 35 is made of a flexible material, and it is immovably supported only on the upstream side in a toner transport direction (the right side of FIG. 2) while being moveable on the opposite side. Also, the end portion of the lateral tube 35 on the upstream side is connected to an intermediate transport path linked to the toner discharge port of the toner container 5*a*, so that toner particles from the toner container 5*a* are supplied to the inside of the lateral tube 35.

The lateral screw 36 has a shaft 36*a* extending along the center of the lateral tube 35 and a helical blade portion 36*b* formed on the outer circumference of the shaft 36*a*. The shaft 36*a* and the blade portion 36*b* are made of an elastomer as a single-piece article. The end portion of the shaft 36*a* is connected to an unillustrated motor so as to be rotated, and toner particles inside the lateral tube 35 are transported from right to left of FIG. 2 in association with rotations of the lateral screw 36. It should be noted that the tip end 36*c* of the shaft 36*a* is a free end.

The longitudinal transport device 32 has a toner replenishing pipe 38 (longitudinal tube: second tube) that is free to move in the vertical direction, a longitudinal screw 39 (second transport member) serving as a longitudinal transport member provided inside the toner replenishing pipe 38 in a rotatable manner, and a driving mechanism 40 that drives the toner replenishing pipe 38.

The toner replenishing pipe 38 is long in the vertical direction and is disposed so that the center shaft thereof inclines at a specific angle with respect to a horizontal line. The tip end of the toner replenishing pipe 38 is tapered, so that when moved downward, the tip end is allowed to go inside the developing device 16 by passing through the slip made in the toner supply port.

The longitudinal screw 39 has a shaft 39*a* extending along the center of the toner replenishing pipe 38 and a helical blade portion 39*b* formed on the outer circumference of the shaft 39*a*. The shaft 39*a* and the blade portion 39*b* are made of resin as a single-piece article. The end portion of the shaft 39*a* is connected to an unillustrated motor via a gear or the like so as to be rotated, and toner particles inside the toner replenishing pipe 38 drop by a force of gravity while being transported downward in association with rotations of the longitudinal screw 39.

It should be noted that the tip end of the lateral tube 35 (the end portion on the downstream side in the toner transport direction) is coupled to the upper portion of the toner replenishing pipe 38 and inner spaces in these two components communicate with each other at this coupling portion. In a portion to which the lateral tube 35 is coupled, a part 39*c* in the blade portion 39*b* of the longitudinal screw 39 is notched. The tip end 36*c* of the lateral screw 36 goes into the notched portion 39*c* in the blade portion 39*b* of the longitudinal screw 39. To be more concrete, the tip end 36*c* of the lateral screw 36 on the downstream side in the toner transport direction passes through the notched portion 39*c* in the blade portion 39*b* and is positioned between the inner wall of the toner replenishing pipe 38 and the shaft 39*a* of the longitudinal screw 39 at an inner portion (on the side closer to the shaft 39*a*) than the major diameter of the blade portion 39*b* of the longitudinal screw 39.

Figure 3:
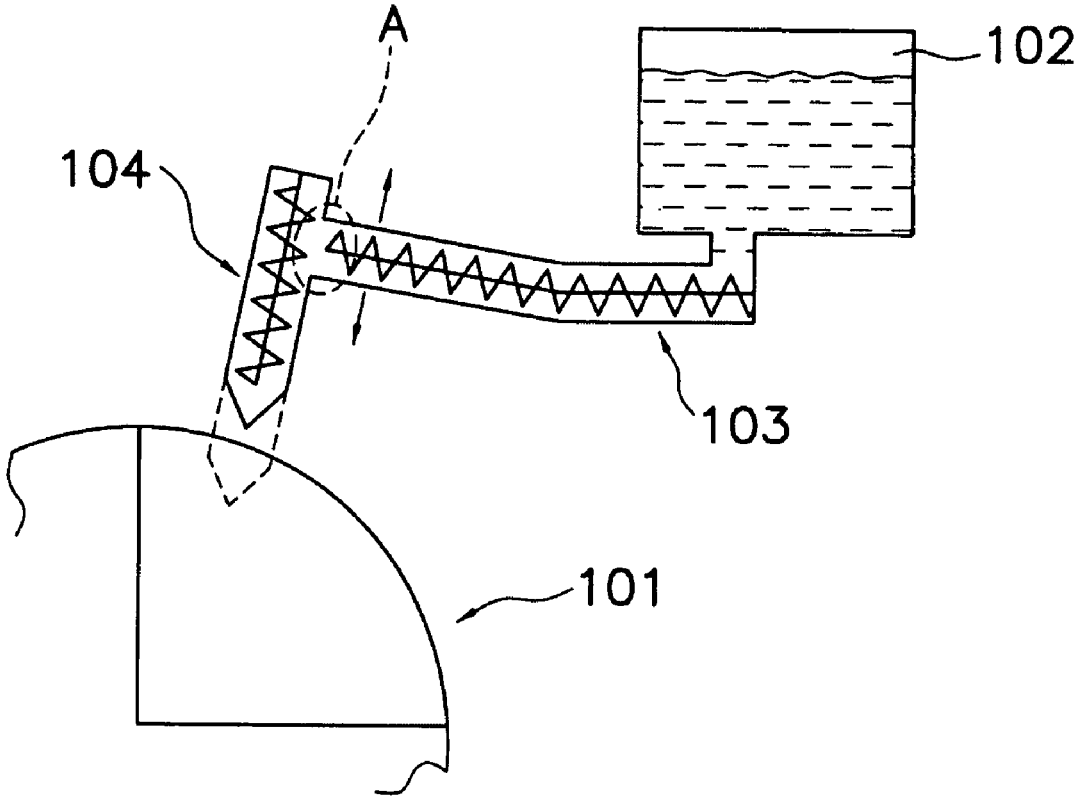
FIG. 3 is a schematic view used to describe a problem in the toner transport apparatus.

The reason why the configuration as described above is adopted in this embodiment will now be described with reference to FIG. 3. FIG. 3 is a schematic view used to describe a problem in a case where a transport device that transports toner particles in a lateral direction and another transport device that transports toner particles in a longitudinal direction are used. FIG. 3 shows the configuration in which a lateral transport device 103 and a longitudinal transport device 104 serving as a toner replenishing pipe are provided to replenish a rotary developing apparatus 101 with toner particles from an outside toner container 102, and each of the transport devices 103 and 104 is provided with a screw that transports toner particles.

In the configuration for toner transportation as described above, it is necessary to form the toner replenishing pipe 104 to be free to move up and down so that it can be located at a replenishing position at which it goes inside the developing device and at a stand-by position outside the developing device. Hence, the lateral transport device 103 has to have a free end on the downstream side in the toner transport direction (on the side coupled to the toner replenishing pipe 104) so that it is allowed to move in accordance with the moving up and down of the toner replenishing pipe 104. The supporting structure of the lateral transport device 103 therefore has to be a supporting structure in which only a portion on the upstream side in the toner transport direction is immovably supported.

Under the circumstances described above, it is impossible to assemble the respective members at a higher degree of accuracy. Hence, by taking an accumulated tolerance into account, in order to avoid an interference of the screw of the lateral transport device 103 with the screw of the longitudinal transport device 104, it is necessary to provide the tip end portion of the lateral transport device 103 sufficiently spaced apart from the screw of the longitudinal transport device 104. However, toner particles are not delivered in a satisfactory manner in a space between the both screws (region A enclosed in a broken line of FIG. 3) and toner particles may possibly build up therein.

In view of such a problem, in this embodiment, the tip end 36*c* of the lateral screw 36 is allowed to go into the notched portion 39*c* in the blade portion 39*b* provided to the longitudinal screw 39. This configuration solves the problematic build-up of toner particles and enables a satisfactory delivery of toner particles to be achieved.

Figure 4B:
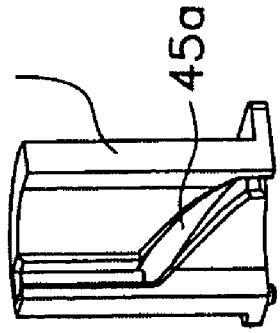
FIGS. 4A and 4B are perspective views showing a driving mechanism of a toner replenishing pipe.
Figure 4A:
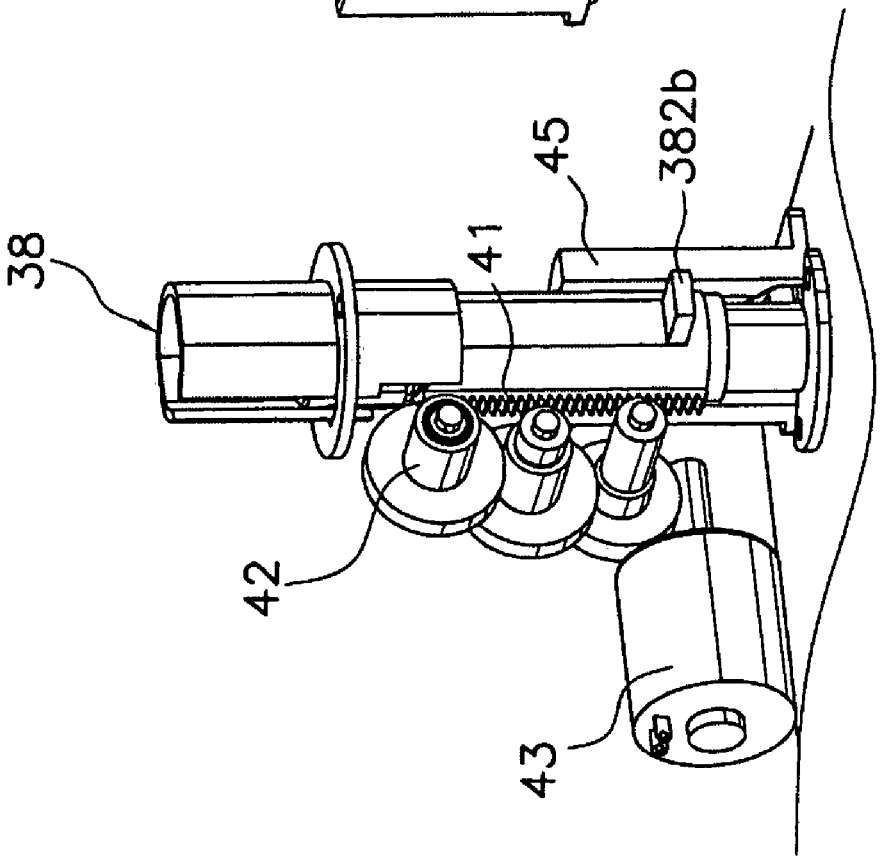

As is obvious from FIG. 2 and FIGS. 4A and 4B showing the taken out driving mechanism 40, the driving mechanism 40 has a rack 41 provided to the outer circumference portion of the toner replenishing pipe 38 along the axial direction and a pinion gear 42 that engages with the rack 41. The pinion gear 42 is supported on the frame of the apparatus in a rotatable manner, and as is shown in FIG. 4A, it is driven by a motor 43, a worm, a worm wheel, and a deceleration gear array. The driving mechanism 40 allows the four toner replenishing pipes 38 to be located at the upper stand-by position (the position indicated by a solid line in FIG. 1) and the lower supply position (the position indicated by a chain double-dashed line in FIG. 1) at which the tip end portions thereof go inside the corresponding developing devices 16.

Figure 5A:
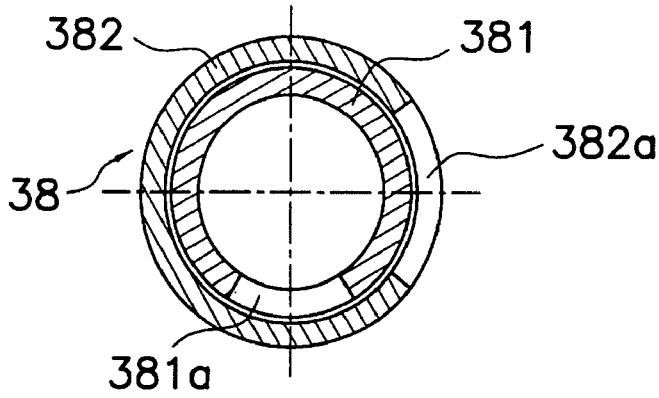
FIGS. 5A through 5C are views showing the configuration of the tip end of the toner replenishing pipe, FIGS. 5A and 5B being cross sections of the toner replenishing pipe and FIG. 5C being a front view of the tip end portion of the toner replenishing pipe.
Figure 5B:
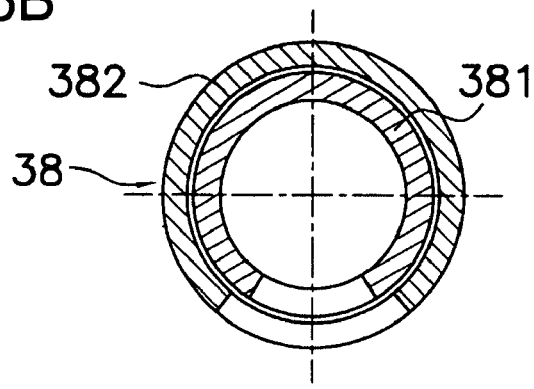
Figure 5C:
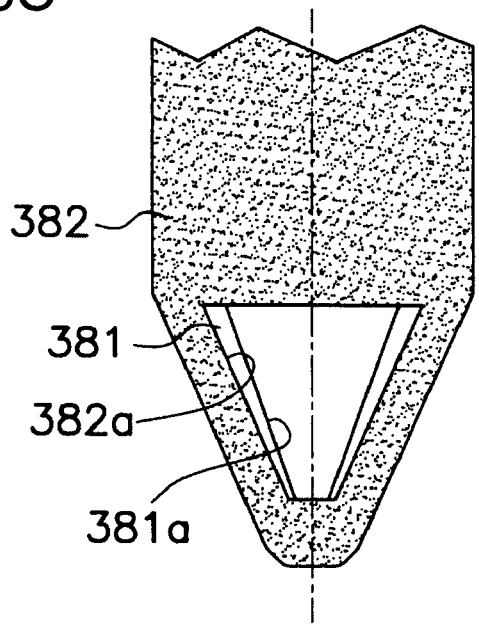

Each toner replenishing pipe 38 has a shutter mechanism that opens only when the toner replenishing pipe 38 is located at the supply position. The shutter mechanism will be described concretely using FIGS. 4A and 4B and FIGS. 5A through 5C. FIGS. 5A and 5B are cross sections of the toner replenishing pipe 38, and FIG. 5C is a front view of the tip end portion of the toner replenishing pipe 38.

As are shown in these drawings, the toner replenishing pipe 38 is of a double structure having an inner tube portion 381 and an outer tube portion 382 capable of rotating relatively with respect to each other. Openings 381*a* and 382*a* are made in parts of the tube portions 381 and 382, respectively, in the circumferential direction at the tip ends. As is shown in FIG. 4A, the outer tube portion 382 is provided with a protrusion 382*b* on the outer circumferential surface, and the protrusion 382*b* engages with a rotating cam 45 disposed on the outer circumference of the outer tube portion 382 and provided with a helical guide portion 45*a* as is shown in FIG. 4B. FIG. 4B shows an exploded view of the rotating cam 45 alone for ease of understanding.

When the toner replenishing pipe 38 is at the upper stand-by position, the opening 381*a* in the inner tube portion 381 does not coincide with the opening 382*a* in the outer tube portion 382 (FIG. 5A: shutter is closed), and toner particles will never run out to the outside. Meanwhile, when the toner replenishing pipe 38 moves downward, the outer tube portion 382 rotates owing to the engagement of the protrusion 382*b* with the helical guide portion 45*a* of the rotating cam 45. When the tip end portion of the toner replenishing pipe 38 goes inside the developing device 16 and is located at the supply position, the opening 381*a* in the inner tube portion 381 coincides with the opening 382*a* in the outer tube portion 382 (FIGS. 5B and 5C: shutter is open). Toner particles inside the toner replenishing pipe 38 are therefore supplied to the inside of the developing device 16 through the openings 381*a* and 382*a*.

Image Forming Operation

An image forming operation will now be described briefly. Initially, when the power supply of the color printer 1 is turned on, various parameters are initialized and initial settings, such as the temperature setting in the fixing portion, are executed. Image data is then inputted to the color printer 1 from a computer or the like connected thereto, and upon receipt of a print start command, an image forming operation is executed as described below. It should be noted that during the image forming operation, the toner replenishing pipes 38 are moved to the upper stand-by positions.

Initially, the surface of the photoconductive drum 2 is charged, and exposing light is then scanned on the photoconductive drum 2 from the laser unit 4 according to the image data. An electrostatic latent image is thus formed on the surface of the photoconductive drum 2. Subsequently, the rotary developing apparatus 3 is rotated and the developing devices 16 for the corresponding colors are placed oppositely to the photoconductive drum 2. In this state, the electrostatic latent image on the photoconductive drum 2 is developed into toner images with toner particles in the corresponding colors. The image thus developed is transferred onto the intermediate transfer belt 7. By repetitively performing the operation as described above for each color, a full-color image is formed on the intermediate transfer belt 7.

Meanwhile, one recording sheet is taken out from the sheet feeding cassette 20, and this recording sheet is carried and guided to the secondary transfer roller 8 in timing with the image formation on the intermediate transfer belt 7. The full-color image formed on the intermediate transfer belt 7 is transferred onto the recording sheet at the portion of the secondary roller 8. The recording sheet on which is transferred the image is discharged onto the discharge portion 21 after it is guided to the fixing device 9 for the image to be fixed onto the recording sheet.

Toner Replenishing Operation

When toner particles inside the developing devices 16 are consumed to a specific amount or less, toner particles are replenished to the developing devices 16 from the corresponding toner containers. In a case where toner particles are replenished to the developing devices 16, the rotary developing apparatus 3 is rotated to locate the developing device 16 that needs replenishing of toner particles to the replenishing position as shown in FIG. 1. The rotary developing apparatus 3 is locked in this state so as not to rotate further.

Subsequently, the toner replenishing pipe 38 is moved downward to be located at the supply position. To be more specific, when the motor 43 is driven, the pinion gear 42 starts to rotate via the gear array, which causes the toner replenishing pipe 38 to which the rack 41 is fixed to move downward. The tip end of the toner replenishing pipe 38 thus passes through the slit in the toner supply port and goes inside the developing device 16. In association with the downward movement of the toner replenishing pipe 38, the outer tube portion 382 rotates with respect to the inner tube portion 381, both of which form the toner replenishing pipe 38. At a point in time when the tip end of the toner replenishing pipe 38 goes inside the developing device 16, the opening 382*a* in the outer tube portion 382 coincides with the opening 381*a* in the inner tube portion 381. In short, the shutter mechanism opens.

Meanwhile, as the lateral screw 36 inside the lateral tube 35 rotates, toner particles from the toner container are supplied toward the toner replenishing pipe 38. In this instance, the tip end 36*c* of the lateral screw 36 of the lateral transport device 31 has gone inside the toner replenishing pipe 38 near the shaft 39*a* of the longitudinal screw 39. To be more specific, the tip end 36*c* of the lateral screw 36 extends to a point between the inner wall of the toner replenishing pipe 38 and the shaft 39*a* of the longitudinal screw 39 at the notched portion 39*c* in the blade portion 39*b* of the longitudinal screw 39.

Toner particles are therefore transported to the longitudinal screw 39 inside the toner replenishing pipe 38 by the lateral screw 36 in a reliable manner. On the longitudinal transport device 32 side, toner particles transported to the inside of the toner replenishing pipe 38 fall down by the force of gravity while being transported downward in association with rotations of the longitudinal screw 39. Toner particles are then replenished to the inside of the developing device 16 via the openings 381*a* and 382*a* in the toner replenishing pipe 38.

In this embodiment as described above, because the tip end 36*c* of the lateral screw 36 goes inside the toner replenishing pipe 38 near the center thereof, toner particles are transported smoothly at the coupling portion of the lateral transport device 31 and the longitudinal transport device 32. It is thus possible to prevent toner particles from accumulating in the coupling portion, which can in turn prevent built-up of toner particles occurring in a conventional apparatus.

OTHER EMBODIMENTS (a) In the embodiment above, the invention was used in the toner supply portion in a rotary developing apparatus. Applications of the invention, however, are not limited to the embodiment above. For example, in a case where toner particles after cleaning are used again, the invention is applicable to a toner transport apparatus that transfers recycle toner particles from a collected toner container (first container) that stores collected toner particles to a developing device (second container). Alternatively, in a case where toner particles after cleaning are disposed of, the invention is applicable to a toner transport apparatus that transfers wasted toner particles from a collected toner container (first container) storing collected toner particles to a waster toner container (second container).

(b) In the embodiment above, a screw formed of the shaft and the helical blade portion was used as the lateral and longitudinal transport members. However, components forming each transport member are not limited to those specified above. For example, it may be configured in such a manner that a transport member has the shaft in a part on the driving side alone and one end of a coil spring is coupled to the shaft.

(c) The configuration of the longitudinal screw is not limited to the one described in the embodiment above. To be more specific, in the embodiment above, a part of the blade portion of the longitudinal screw is notched so that the tip end of the lateral screw is allowed to go into the notched portion. Instead of this configuration, it may be configured in such a manner that the blade portion is omitted from the upper portion where the tip end of the lateral screw goes in and the blade portion is formed below a portion where the tip end of the lateral screw goes in.

The specific embodiments described above include inventions having the following configurations.

A toner transport apparatus according to one aspect of the invention is provided with: a lateral transport device that includes a lateral tube extending in a lateral direction and a lateral transport member provided inside the lateral tube in a rotatable manner and transporting toner particles; and a longitudinal transport device that includes a longitudinal tube coupled to an end of the lateral tube and extending in a longitudinal direction and a longitudinal transport member provided inside the longitudinal tube in a rotatable manner and transporting toner particles downward, and thereby transports the toner particles transported from the lateral transport device downward, wherein an end portion of the lateral transport member on a downstream side in a toner transport direction extends to an inside of the longitudinal tube.

An image forming apparatus according to another aspect of the invention includes: an electrostatic latent image carrying body; a developing apparatus that supplies the electrostatic latent image carrying body with toner particles; a toner container that stores the toner particles; and a toner transport apparatus that transports the toner particles from the toner container to the developing apparatus, wherein the toner transport apparatus has the configuration described above.

According to these configurations, in the lateral transport device, toner particles inside the lateral tube are transported in the lateral direction by the lateral transport member. The toner particles transported in the lateral direction are further transported inside the longitudinal tube in the longitudinal transport device. In the longitudinal transport device, toner particles inside the longitudinal tube are transported downward by the longitudinal transport member.

In this instance, because the lateral transport member in the lateral transport device extends to the inside of the longitudinal tube, toner particles from the lateral transport device are delivered to the inside of the longitudinal tube in a reliable manner. It is thus possible to suppress built-up of toner particles in the coupling portion of the lateral transport device and the longitudinal transport device.

In the configurations described above, it is preferable to configure in such a manner that: the longitudinal transport member has a shaft and a blade member provided helically on a periphery of the shaft; the end portion of the lateral transport member on the downstream side in the toner transport direction extends to a point between an inner wall of the longitudinal tube and the shaft of the longitudinal transport member; and the blade member of the longitudinal transport member is omitted from a portion where the end portion of the lateral transport member on the downstream side in the toner transport direction is located.

By omitting the blade member in a portion of the longitudinal transport member and disposing the tip end portion of the lateral transport member in this portion, the lateral transport member is allowed to go inside without having an interference with the longitudinal transport member in the longitudinal transport device. It is thus possible to deliver toner particles from the lateral transport device to the longitudinal transport device in a more satisfactory manner.

In the configurations described above, it is preferable that the lateral tube is immovably supported only at an end portion on an upstream side in the toner transport direction. By adopting the structure in which the lateral tube is immovably supported on one side alone, the tip end side is allowed to move freely. It is thus possible to allow the longitudinal transport device to move up and down.

In addition, in the case of the structure in which the lateral tube is immovably supported on one side alone, an accumulated tolerance becomes larger as an assemble error becomes relatively large, which readily gives rise to an interference of the tip end of the lateral transport member with the longitudinal transport member. However, by configuring in such a manner that the blade member is omitted from a portion of the longitudinal transport member and by locating the tip end of the lateral transport member in this portion where the blade member is omitted, it is possible to avoid the interference even when the lateral transport member goes inside the longitudinal transport device.

In this case, it is preferable to further provide an elevating mechanism that moves up and down the longitudinal transport device, and to configure in such a manner that the lateral transport device is moveable on the downstream side in the toner transport direction in accordance with moving up and down of the longitudinal transport device.

A toner transport apparatus according to still another aspect of the invention is provided with: a first transport device that includes a first tube extending in a specific first direction and a first transport member provided inside the first tube in a rotatable manner and transporting toner particles in the first direction; and a second transport device that includes a second tube coupled to an end of the first tube and extending in a second direction different from the first direction and a second transport member provided inside the second tube in a rotatable manner and transporting toner particles in the second direction, and thereby transports the toner particles transported from the first transport device in the second direction, wherein an end portion of the first transport member on a downstream side in a toner transport direction extends to an inside of the second tube.

An image forming apparatus according to still another aspect of the invention includes: an image forming portion that forms an image using toner particles; a first container that stores the toner particles; a second container into which the toner particles stored in the first container are transferred; and a toner transport apparatus that transports the toner particles from the first container to the second container, wherein the toner transport apparatus has the configuration described above.

This application is based on patent application No. 2006-126216 filed in Japan, the contents of which are hereby incorporated by references.

As has been described, according to the invention, it is possible for an apparatus that transports toner particles laterally and longitudinally to deliver the toner particles in a satisfactory manner at transition between lateral transportation and longitudinal transportation, which can in turn prevent built-up of toner particles.

What is claimed is:

1. A toner transport apparatus that transports toner particles, comprising:

a lateral transport device that includes a lateral tube extending in a lateral direction and a lateral transport member provided inside the lateral tube in a rotatable manner and transporting toner particles; and a longitudinal transport device that includes a longitudinal tube coupled to an end of the lateral tube and extending in a longitudinal direction and a longitudinal transport member provided inside the longitudinal tube in a rotatable manner and transporting toner particles downward, and thereby transports the toner particles transported from the lateral transport device downward, the longitudinal transport member has a shaft and a blade member provided helically on a periphery of the shaft;

wherein an end portion of the lateral transport member on a downstream side in a toner transport direction extends to a point between an inner wall of the longitudinal tube and the shaft of the longitudinal transport member; and the blade member of the longitudinal transport member is omitted from a portion where the end portion of the lateral transport member on the downstream side in the toner transport direction is located.

2. The toner transport apparatus according to claim 1, wherein:

the lateral tube is immovably supported only at an end portion on an upstream side in the toner transport direction.

3. The toner transport apparatus according to claim 2, further comprising:

an elevating mechanism that moves the longitudinal transport device up and down, wherein the lateral transport device is movable on the downstream side in the toner transport direction in accordance with moving up and down of the longitudinal transport device.

4. A toner transport apparatus that transports toner particles, comprising:

a first transport device that includes a first tube extending in a specific first direction and a first transport member provided inside the first tube in a rotatable manner and transporting toner particles in the first direction; and a second transport device that includes a second tube coupled to an end of the first tube and extending in a second direction different from the first direction and a second transport member provided inside the second tube in a rotatable manner and transporting toner particles in the second direction, and thereby transports the toner particles transported from the first transport device in the second direction, the second transport member has a shaft and a blade member provided helically on a periphery of the shaft;

wherein an end portion of the first transport member on a downstream side in a toner transport direction extends to a point between an inner wall of the second tube and the shaft of the second transport member; and the blade member of the second transport member is omitted from a portion where the end portion of the first transport member on the downstream side in the toner transport direction is located.

5. The toner transport apparatus according to claim 4, wherein:

the first tube is immovably supported only at an end portion on an upstream side in the toner transport direction.

6. The toner transport apparatus according to claim 5, further comprising:

an elevating mechanism that moves the second transport device up and down, wherein the first transport device is moveable on the downstream side in the toner transport direction in accordance with moving up and down of the second transport device.

7. An image forming apparatus, comprising:

an electrostatic latent image carrying body;

a developing apparatus that supplies the electrostatic latent image carrying body with toner particles;

a toner container that stores the toner particles; and a toner transport apparatus that transports the toner particles from the toner container to the developing apparatus, wherein the toner transport apparatus comprises:

a lateral transport device that includes a lateral tube extending in a lateral direction and a lateral transport member provided inside the lateral tube in a rotatable manner and transporting toner particles; and a longitudinal transport device that includes a longitudinal tube coupled to an end of the lateral tube and extending in a longitudinal direction and a longitudinal transport member provided inside the longitudinal tube in a rotatable manner and transporting toner particles downward, and thereby transports the toner particles transported from the lateral transport device downward, the longitudinal transport member has a shaft and a blade member provided helically on a periphery of the shaft;

wherein an end portion of the lateral transport member on a downstream side in a toner transport direction extends to a point between an inner wall of the longitudinal tube and the shaft of the longitudinal transport member; and the blade member of the longitudinal transport member is omitted from a portion where the end portion of the lateral transport.

8. The image forming apparatus according to claim 7, wherein:

the lateral tube is immovably supported only at an end portion on an upstream side in the toner transport direction.

9. The image forming apparatus according to claim 8, further comprising:

an elevating mechanism that moves the longitudinal transport device up and down, wherein the lateral transport device is moveable on the downstream side in the toner transport direction in accordance with moving up and down of the longitudinal transport device.

10. The image forming apparatus according to claim 7, wherein:

the developing apparatus is a rotary developing apparatus.

11. An image forming apparatus, comprising:

an image forming portion that forms an image using toner particles;

a first container that stores the toner particles;

a second container into which the toner particles stored in the first container are transferred; and a toner transport apparatus that transports the toner particles from the first container to the second container, wherein the toner transport apparatus comprises:

a first transport device that includes a first tube extending in a specific first direction and a first transport member provided inside the first tube in a rotatable manner and transporting toner particles in the first direction; and a second transport device that includes a second tube coupled to an end of the first tube and extending in a second direction different from the first direction and a second transport member provided inside the second tube in a rotatable manner and transporting toner particles in the second direction, and thereby transports the toner particles transported from the first transport device in the second direction, the second transport member has a shaft and a blade member provided helically on a periphery of the shaft;

wherein an end portion of the first transport member on a downstream side in a toner transport direction extends to a point between an inner wall of the second tube and the shaft of the second transport member; and the blade member of the second transport member is omitted from a portion where the end portion of the first transport member on the downstream side in the toner transport direction is located.

12. The image forming apparatus according to claim 11, wherein:

the first tube is immovably supported only at an end portion on an upstream side in the toner transport direction.

13. The image forming apparatus according to claim 12, further comprising:

an elevating mechanism that moves the second transport device up and down, wherein the first transport device is moveable on the downstream side in the toner transport direction in accordance with moving up and down of the second transport device.

* * * * *